US005188231A

United States Patent [19]

Kivell et al.

[11] Patent Number: 5,188,231

[45] Date of Patent: Feb. 23, 1993

[54] BATTERY PACKAGE WITH REMOVABLE VOLTAGE INDICATOR MEANS

[75] Inventors: Larry Kivell, Milton, Canada; Robert L. Milanese, Brookfield; Charles E. Kiernan, Westport, both of; Lorne Tittel, Thornhill, Canada

[73] Assignee: Duracell Inc., Bethel, Conn.

[21] Appl. No.: 708,324

[22] Filed: May 31, 1991

[51] Int. Cl.[5] ..... B65D 85/20

[52] U.S. Cl. ..... 206/333; 206/459; 206/459.1

[58] Field of Search ..... 206/328, 333, 459; 324/104

[56] References Cited

U.S. PATENT DOCUMENTS 4,702,563 10/1987 Parker ..... 324/104
4,702,564 10/1987 Parker ..... 324/104
4,723,656 2/1988 Kiernan et al. ..... 206/333
4,726,661 2/1988 Parker ..... 324/104

*Primary Examiner*—Jimmy G. Foster
*Attorney, Agent, or Firm*—Ronald S. Cornell; James B. McVeigh, Jr.

[57] ABSTRACT

The present invention is a package for the sale and display of batteries having a voltage indicator integrally associated with the package. A pair of electrical contacts are associated with the voltage indicator and the contacts are so positioned on the package that they are accessible for alignment with the terminals of a battery placed therebetween. When the electrical contacts make simultaneous connection to the terminals of a battery, current flows through the voltage indicator to visually indicate the magnitude of the voltage of the battery.

10 Claims, 2 Drawing Sheets

BATTERY PACKAGE WITH REMOVABLE VOLTAGE INDICATOR MEANS

This invention relates to a battery voltage tester and a package for the sale and display of batteries having the voltage tester removably supplied therewith. Such a combination allows the consumer to readily test the "freshness" of batteries upon purchase and to easily store the tester for later use. The voltage tester is shaped so that it is easily contacted to the terminals of a battery to give a visual indication of the battery's voltage.

The voltage tester of the present invention comprises a receptacle shaped to receive a particular battery size and a voltage indicator means which comprises a material which indicates an applied voltage by undergoing a physical change. The receptacle is shaped so that the electrical contacts are in a relatively fized position, making alignment with the terminals of a battery easier than is possible with flat voltage testers heretofore sold. The voltage indicator means comprises a thermochromic material which responds to a voltage dependent temperature generated in the tester. The properties of the thermochromic material are such that the response is evidenced by a color change. Therefore, when the voltage indicator means is connected across the positive and negative terminals of a battery there is a color change which corresponds to the voltage of the battery. Thus, the consumer is provided with a visually discernable change which gives an indication of the quality of batteries.

Battery testers in the form of a flat sheet and including liquid crystal materials as visual indicators are known. U.S. Pat. No. 3,667,039 discloses a device which has a liquid crystal material contained within a rigid housing. One embodiment measures voltage by establishing an electric field gradient across the liquid crystal material. Another embodiment measures current by detecting a change in temperature. These designs are far more complicated in construction than the design of the present invention and would be too costly to incorporate into a package used for commercially marketing batteries.

U.S. Pat. No. 4,006,414 discloses a voltage or current indicating device which is simply constructed and whose principal of operation is the preferred type for use in this invention. While this invention is principally directed at a current indicator which provides an irreversible indication of the magnitude of current it also discloses that it could be made reversible.

U.S. Pat. Nos. 4,702,563 and 4,702,564 disclose a battery tester of the type described in U.S. Pat. No. 4,006,414. These inventions mount the voltage indicating device on a flexible transparent substrate. The resistive element through which current passes when connected to the terminals of a battery is bow-tie shaped and is mounted on one side of the flexible substrate. The liquid crystal material is deposited on the substrate side opposite to the bow-tie shaped element so as to be coincident therewith. The flexible character of the substrate permits it to be bent around a variety of cylindrical battery sizes in order to contact terminals located on opposite ends of the battery. A disadvantage of this device is that it is made to accommodate all battery sizes, and therefore it can be awkward to handle when testing small batteries because its size must also be able to accommodate large batteries. This can make it difficult to align the contacts to the terminals of a small battery. U.S. Pat. No. 4,726,661 discloses a battery tester which operates in a manner similar to those described immediately above but is designed to facilitate testing of small button-type batteries.

U.S. Pat. No. 4,723,656 discloses a package for the sale and display of batteries which has a voltage indicator integrally associated with the package. A pair of electrical contacts are located on the package for alignment with the terminals of a battery placed therebetween. This invention is an improvement over the sheet-like indicators because the contacts are pre-positioned for easy alignment with the terminals of a battery. However, the entire blister-potion of the package must be saved for future use of the voltage indicator.

It is an object of the present invention to provide a package for the sale and display of batteries, wherein a removable voltage tester is associated with the package.

It is an additional object to provide a reversible voltage indicating means so that the voltage of a battery can be tested throughout its life as well as just after purchase.

The objects, features, and advantages of the invention will become clear from the following discussion and drawings in which.

Generally speaking, the present invention is a package for the sale and display of batteries having a removable voltage tester included within the package. The package comprises a holding means for containing one or more batteries and a removable voltage tester. The tester is shaped so that the electrical contacts of the voltage indicating means are disposed in such a manner that a battery fits closely between the contacts. The user then simply squeezes the contacts onto the battery terminals to test the battery's voltage. When the electrical contacts make simultaneous connection to the terminals of a battery, current will flow through the tester to visually indicate the magnitude of the voltage of the battery.

Figure 1:
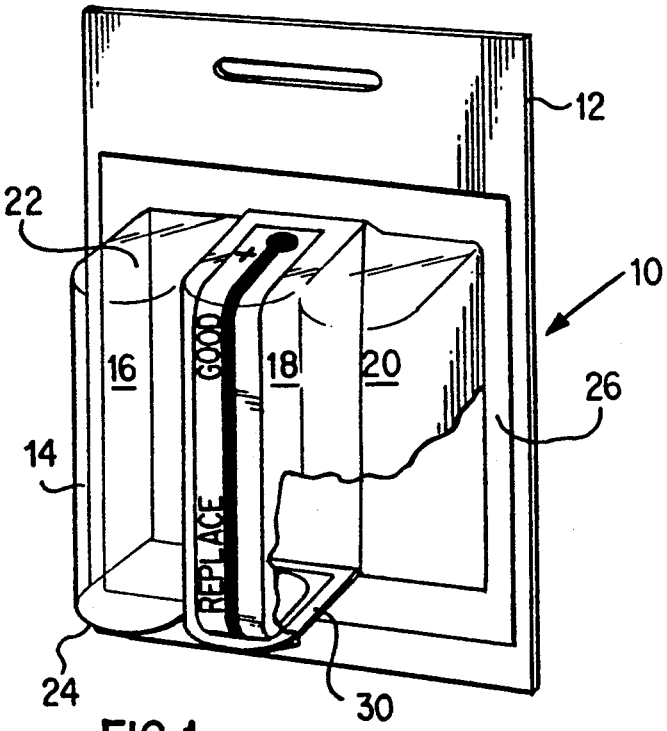
FIG. 1 shows a cut-away view of an embodiment of a blister card package for holding batteries and having a removable voltage tester contained therein.

FIGS. 1–5C will help provide a more detailed understanding of the present invention. FIG. 1 shows a blister card package 10 for the sale and display of batteries having voltage tester 30 removably contained in the the package. The blister card package is comprised of a backing member 12 and a bubble member 14. Bubble member 14 has a peripheral flange 26 attached thereto for attachment to backing member 12. The backing member 12 can be made of any rigid material such as cardboard or plastic. Generally cardboard is the preferred material. Since it is preferred that the batteries and tester are visible through the front of the package it is necessary that bubble member 14 is made of a transparent material. Preferred materials include transparent plastics, such as polyvinylchloride or modified polyvinylchloride, which are rigid and have a mechanical strength sufficient to contain batteries.

Bubble member 14 has a shape which closely conforms to the shape of the batteries and tester being held so that the batteries and tester are firmly held and relatively immobile. As a result, upper surface 22 and lower surface 24 of bubble member 14 are separated by a distance approximately equal to the height of the batteries being held. When the batteries are of the cylindrical type upper surface 22 and lower surface 24 directly oppose the positive and negative terminals, respectively, of the batteries. For the two-cell package shown in FIG. 1 blister 14 is formed having three contoured portions 16, 18, and 20. FIG. 1 shows a part of both portions 18 and 20 cut-away revealing tester 30 nested within portion 18. Portions 16 and 20 have a contour which follows the contour of the batteries being held so that the batteries are firmly held in place. Portion 18 must be large enough to accommodate voltage tester 30. Since voltage tester 30 is slightly larger than the batteries held by portions 16 and 20, portion 18 is slightly wider and higher than portions 16 and 20. Although FIG. 1 shows the voltage tester in the center of bubble member 14 it could also be located at either side of the position shown.

Figure 2:
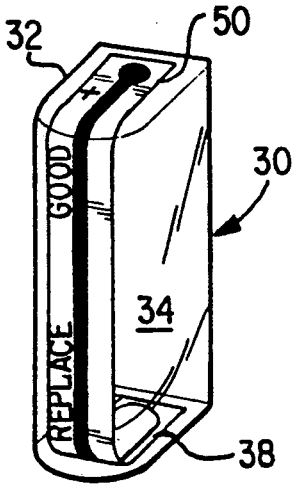
FIG. 2 shows a removable voltage tester.
Figure 2A:
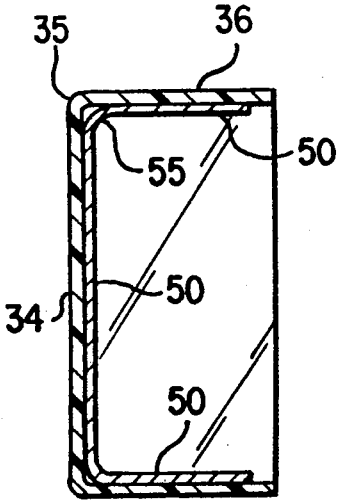
FIG. 2A shows a cross-sectional view along the line A—A through the tester shown in FIG. 2.

FIG. 2 shows an isometric view of a preferred embodiment of voltage tester 30. Tester 30 is comprised of receptacle 32 and voltage indicator 50. Receptacle 32 is comprised of two opposite end portions 36, 38, a curved wall portion 34 therebetween, and an open back for inserting a battery therein. Wall portion 34 and end portions 36, 38 in combination form a receptacle having a shape complimentary for placing a battery therein. Voltage indicator 50 is located on the inside surface of receptacle 32 with an electrical contact 53 disposed on each of end portions 36, 38. It is preferred that voltage indicator 50 is not folded at corner 35 of receptacle 32 but rather has a more rounded bend 55. Otherwise, the electrical resistance of resistor 54 at bend 55 would be adversely effected if a fold, rather than a gradual bend, was used.

Figure 3:
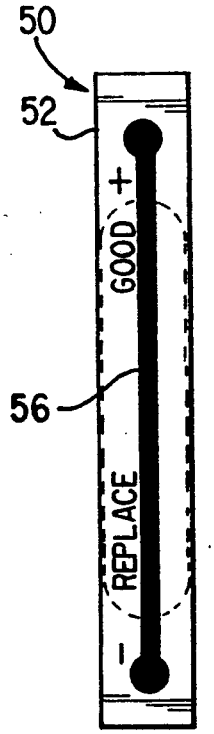
FIG. 3 shows a front view of a voltage indicating means.
Figure 3A:
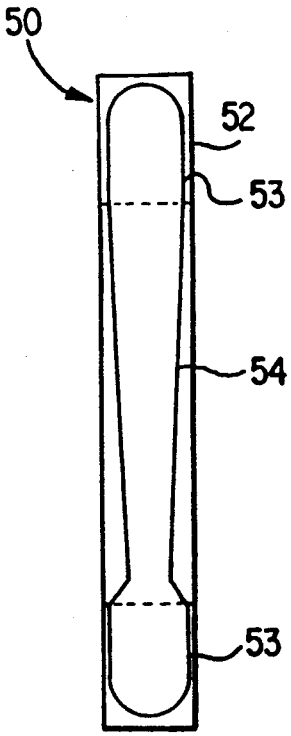
FIG. 3A shows a rear view of the voltage indicating means shown in FIG. 3.

The voltage indicator 50, as shown in FIGS. 3 and 3A, is comprised of substrate 52 having voltage scale 56 printed on the front side. The other side has resistive element 54 located on the middle portion of the substrate and electrical contacts 53 located at opposite ends thereof connected to resistive element 54. The substrate can be made of stiffened paper, plastic, cardboard and the like. The substrate should not be electrically conductive and it should not have an appreciable thermal mass so that heat can be readily transferred through it. The length of the strip is sufficient so that the two contacts 53 are disposed on opposite ends 36, 38 of receptacle 30 when the voltage indicating means is fixed to the inside surface thereof. Specific aspects concerning the construction of voltage indicating means 39 are disclosed in U.S. Pat. No. 4,723,656, the teachings of which are incorporated herein by reference.

It is preferred that the temperature responsive material on the front of voltage indicating means 39 is selected from the group consisting of liquid crystal polymers and thermochromic inks. The choice between liquid crystal or thermochromic ink depends on the desired visual output of the tester. Liquid crystal materials, and in particular cholesteric liquid crystal materials, are clear at room temperature and change to a color at elevated temperatures. This embodiment provides a colored band over voltage scale 56 which moves up the scale to an extent dependent on the heat generated in resistive element 54 during testing. A thermochromic ink, on the other hand, changes from being colored, or black, at room temperature, to being clear at an elevated temperature. This embodiment initially blocks scale 56 from view but, during testing, scale 56 becomes visible, from bottom to top, to an extent dependent on the heat generated in resistive element 54. The color change effects of either liquid crystals or thermochromic inks are reversible so that the tester can be used over and over. It is most preferred that thermochromic inks are used because a more dramatic effect can be achieved by using a bright colors in the voltage scale which is revealed when the ink becomes clear.

Figure 4:
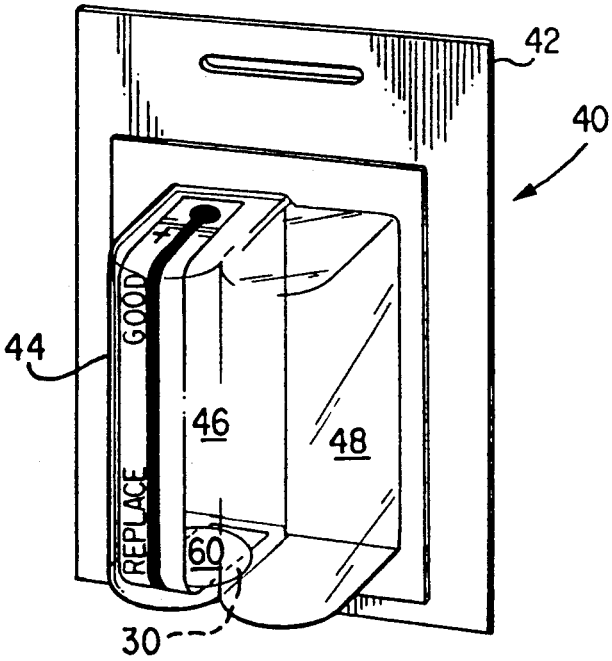
FIG. 4 shows a blister card package for holding two batteries and a voltage tester.
Figure 4A:
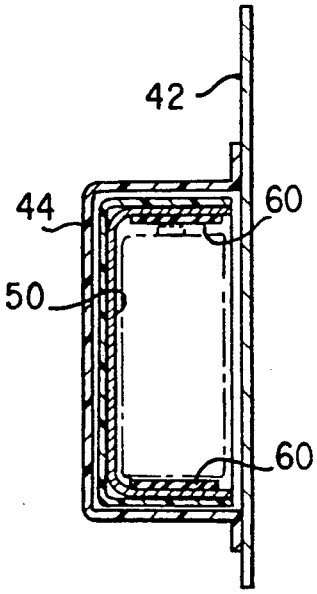
FIG. 4A is a cross-sectional view along the line A—A through the blister card package shown in FIG. 4.

FIG. 4 shows an embodiment which is more preferred for larger cell sizes, such as "C" and "D" sizes. Battery packages have a standard width in the industry of about 4 inches and 3 "D" size cells side-by-side are almost 4 inches wide so that the embodiment shown in FIG. 1 would not easily work for "D" size cells. An embodiment of the present invention suitable for "C" and "D" size cells is shown in FIG. 4. The embodiment shown in FIG. 4 has one cell contained within tester 30. This contained cell and another cell are held in side-by-side arrangement by blister 44. Contoured blister portion 46 must be larger than contoured blister portion 48 since the cell contained within tester 30 is larger than a single cell. It is preferred that removable insulating means 60 is disposed between at least one battery terminal and the opposing tester contact so that the contained cell can not be tested while it is on sale. Otherwise, repeated or continuous testing while the battery is held within the package would partially discharge the battery since the voltage test draws current from the battery. The consumer removes insulating means 60 after purchase so that the tester can be used. FIG. 4A shows insulating means 60 disposed at each battery terminal but it is only necessary to have it disposed at one terminal. Insulating means 60 can be made of any shape which is large enough to prevent electrical contact between the cell terminal and the tester contact. Materials for fabricating insulating means 60 include but are not limited to cardboard, plastic, paper and the like.

Figure 5A:
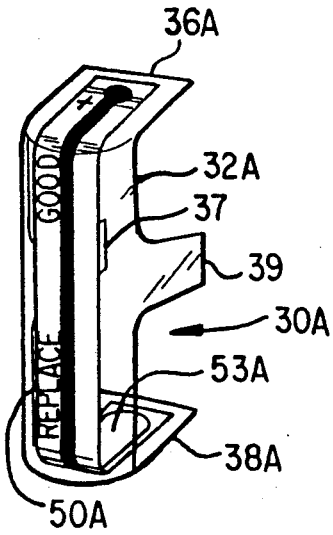
FIG. 5A shows a removable voltage tester having an alternative shape to that shown in FIG. 2.

Other shapes are possible for receptacle 32 that are within the scope of the present invention. FIG. 5A shows tester 30A comprising receptacle 32A and voltage indicator 50A. Receptacle 32A comprises two end portions 36A, 38A, a front portion 34A connected between the end portions, and backwardly extending arm portions 37 and 39 attached to the front portion. Electrical contacts 53A are located on each end portion. As is evident from the figure, a battery can be readily inserted into receptacle **32*a* and easily held in place while end portions 36A and 38A** are squeezed onto the terminals of the battery.

Figure 5B:
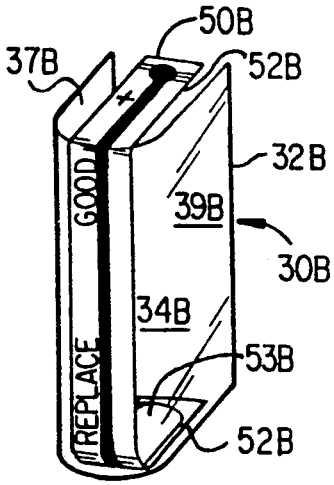
FIG. 5B shows a third embodiment for the removable voltage tester.

FIG. 5B shows another embodiment which is similar to the embodiment shown in FIG. 2 but with the end portions removed. Tester 30B comprises receptacle 32B and voltage indicator 50B. Receptacle 32B comprises a curved front portion 34B and backwardly extending side portions 37B and 39B. Voltage indicator 50B can either be attached to the inside or outside surface of front portion 34B with the end portions 52B of the voltage indicator extending back for alignment with the terminals of a battery being held in receptacle 32B. Electrical contacts 53B ate located on each end portion for alignment with a battery being tested.

Figure 5C:
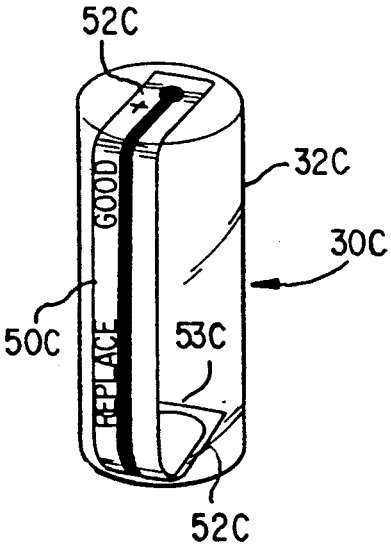
FIG. 5C shows a fourth embodiment for the removable voltage tester.

FIG. 5C shows tester 30C having battery shaped receptacle 32C, in the form of a sleeve, sized to fit over a cylindrical battery casing. Voltage indicator 50C can either be attached to the inside or outside surface of receptacle 32C with end portions 52C extending back over the openings in the sleeve. The electrical contacts 53C are disposed on each end portion to permit alignment with the terminals of a battery being tested. A battery is inserted by bending one of the end portions out of the way, inserting the battery, and bending the end portion back in place.

The above example and descriptions are for illustration and explanation purposes and should not be interpreted to impose any limitations on the invention as claimed. Variations can be made by one with ordinary skill in the art and still remain within the scope of the invention.

What is claimed is:

1. A package for the sale and display of batteries and a voltage tester associated with and removable from the package comprising a holding means for holding at least one battery and the voltage tester in side-by side arrangement; said tester comprising a receptacle and a voltage indicator means integrally associated therewith, said receptacle having two end portions, a front wall portion and two side wall portions connected between said end portions so that said receptacle has an open back, and said indicator means comprising a pair of electrical contacts positioned for alignment with the terminals of a battery placed in the receptacle.

2. The package of claim 1 wherein the voltage indicator means comprises a thermochromic material.

3. The package of claim 2 wherein the thermochromic material is selected from the group consisting of liquid crystals and thermochromic inks.

4. A blister card package for the sale and display of batteries and a voltage tester removable from said package, said package comprising a backing member and a bubble member attached thereto and adapted to hold at least one battery and the voltage tester therebetween in side-by-side arrangement, said voltage tester comprising a receptacle shaped for closely holding a single battery therein and a voltage indicating strip attached to a surface of the receptacle, wherein said receptacle comprises two end portions and a rounded wall portion connected therebetween in such a manner that the combination has an open back for inserting a battery therein, and said voltage indicating strip has a pair of electrical contacts disposed so as to make electrical contact to the terminals of a battery placed in the receptacle, whereby, when the electrical contacts make simultaneous connection to the terminals of a battery, current will flow through the voltage indicating strip to visually indicate the magnitude of the voltage of the battery.

5. The package of claim 4 wherein the voltage indicating strip is comprised of a substrate having a middle portion, a first end portion and a second end portion; and a resistive element located on one side of the middle portion and connected to the pair of electrical contacts wherein one electrical contact is located on each end portion; wherein the length of the strip is sufficient for the contact on the first end portion to connect to one terminal of a battery while the contact on the second end portion connects to the other terminal of the battery; and wherein a layer of thermochromic material is in thermal contact with the resistive element.

6. The package of claim 4 wherein at least two batteries and the tester are held in side by side arrangement so that the tester is between the two batteries.

7. The package of claim 4 wherein at least two batteries and the tester are held with one battery being inside the tester and said battery filled tester is in side-by-side arrangement with the other battery.

8. A blister card package for the sale and display of batteries and a voltage tester removable from said package, said package comprising a backing member and a bubble member attached thereto and adapted to hold at least one battery and the voltage tester therebetween in side-by-side arrangement, said voltage tester comprising a receptacle shaped for closely holding a single battery therein and a voltage indicating strip attached to a surface of the receptacle; said voltage indicating strip comprising a substrate, a resistive element located on one side of the substrate, a thermochromic material located on the opposite side of the substrate in thermal contact with the resistive element, and a pair of electrical contacts disposed so as to make electrical contact to the terminals of a battery placed in the receptacle, and wherein said strip is attached to the inside surface of the receptacle with said thermochromic material facing the inside surface of the receptacle; whereby, when the electrical contacts make simultaneous connection to the terminals of a battery, current will flow through the voltage indicating strip to visually indicate the magnitude of the voltage of the battery.

9. A package for the sale and display of batteries and a voltage tester removable from said package, said package comprising a holding means adapted to hold at least one battery and the voltage tester therebetween in side-by-side arrangement, said voltage tester comprising a receptacle shaped for closely holding a single battery therein and a voltage indicating strip attached to a surface of the receptacle, wherein said receptacle is a battery shaped, open-ended cylinder and a battery is contained within the cylinder, and wherein said indicating strip comprises a pair of electrical contacts adapted to make electrical contact to the terminals of the contained battery, whereby, when the electrical contacts make simultaneous connection to the terminals of the contained battery, current will flow through the voltage indicating strip to visually indicate the magnitude of the voltage of the battery.

10. A blister card package for the sale and display of batteries and a voltage tester removable from said package, said package comprising a backing member and a bubble member attached thereto and adapted to hold at least one battery and the voltage tester therebetween, said voltage tester comprising a receptacle shaped for closely holding a single battery therein and a voltage indicating strip attached to a surface of the receptacle and having a pair of electrical contacts disposed so as to make electrical contact to the terminals of a battery placed in the receptacle, whereby, when the electrical contacts make simultaneous connection to the terminals of a battery, current will flow through the voltage indicating strip to visually indicate the magnitude of the voltage of the battery; wherein at least two batteries and the tester are held in the package with one battery being inside the tester and said battery filled tester is in side-by-side arrangement with the other battery, and further comprising at least one insulating means located between one battery terminal and the electrical contact of the voltage tester juxtaposed thereto.

* * * * *